US005111780A

United States Patent [19]

Hannibal

[11] Patent Number: 5,111,780

[45] Date of Patent: May 12, 1992

[54] DRIVE ARRANGEMENT FOR A CAMSHAFT IN AN INTERNAL COMBUSTION ENGINE

[75] Inventor: Wilhelm Hannibal, Neckarsulm, Fed. Rep. of Germany

[73] Assignee: Audi AG, Ingolstadt, Fed. Rep. of Germany

[21] Appl. No.: 635,111

[22] PCT Filed: Jun. 6, 1989

[86] PCT No.: PCT/EP89/00635

§ 371 Date: Jan. 14, 1991

§ 102(e) Date: Jan. 14, 1991

[87] PCT Pub. No.: WO90/00670

PCT Pub. Date: Jan. 25, 1990

[30] Foreign Application Priority Data

Jul. 15, 1988 [DE] Fed. Rep. of Germany ..... 3824062

[51] Int. Cl.[5] ..... F01L 1/34

[52] U.S. Cl. ..... 123/90.17; 123/90.31; 464/2

[58] Field of Search ..... 123/90.12, 90.15, 90.17, 123/90.31; 464/2

[56] References Cited

U.S. PATENT DOCUMENTS 4,787,345 11/1988 Thoma ..... 123/90.17
4,903,650 2/1990 Ohlendorf et al. .
4,976,229 12/1990 Charles .

FOREIGN PATENT DOCUMENTS 1201546 12/1959 France ..... 464/2

*Primary Examiner*—E. Rollins Cross
*Assistant Examiner*—Weilun Lo
*Attorney, Agent, or Firm*—Kane, Dalsimer, Sullivan, Kurucz, Levy, Eisele and Richard

[57] ABSTRACT

A drive arrangement for a camshaft 2 of an internal combustion engine comprises a device for rotating the camshaft 2 relative to a drive wheel 5. This device has a gear-change sleeve 11 coaxial with the camshaft 2 and axially mobile between two end positions, which is connected, on the one hand, to the drive wheel 5 by a spiral gear 12, 13 and, on the other, to the camshaft 2 by a straight gear 15, 16. To obtain a compact arrangement and to allow one and the same cylinder head to be fitted with either an ordinary camshaft or a camshaft drive with variable valve control times, the camshaft 2 ends in the direction of the drive wheel 5, after a cam 3*a*, and the support bearing 9, which in an ordinary camshaft serves to support the camshaft between the last cam and the drive, is used to support the hub part 7 of the drive wheel 5. On the other side, the drive wheel 5 is supported over an second hub part 8 in an additional bearing 10 in the cylinder head 1, the bearing opening of which is closed off by a cover when an ordinary camshaft is used.

10 Claims, 4 Drawing Sheets

DRIVE ARRANGEMENT FOR A CAMSHAFT IN AN INTERNAL COMBUSTION ENGINE

The invention is directed to a drive arrangement for a camshaft in accordance with the introductory portion of claim 1.

In such drive arrangements for camshafts, which are known, for example, from U.S. Pat. No. 3,258,937 or from the German Offenlegungsschrift 36 16 234, the gear-change sleeve is shifted axially in order to change the valve control times, the gear-change sleeve being rotated relative to the drive wheel because of the spiral gearing. This rotation is passed on to the camshaft by way of the straight gear.

In equipment according to U.S. Pat. No. 3,258,937, the drive wheel is fastened to a shaft, which runs on bearings near the driving wheel in the cylinder head and, at its end averted from the drive wheel, in a recess in the adjacent front side of the camshaft. In a front side recess, it accommodates the gear-change sleeve, which is in driving connection at one end over an external spiral gearing with the driving shaft and, at the other end, over a straight gear with the camshaft. The gear-change sleeve is shifted in the one direction by a spring, which is disposed between the drive shaft and the gear-change sleeve, and, in the other direction, by the oil pressure acting in a pressure chamber. It is possible to change the pressure in this chamber by slide valve, which is disposed axially displaceably in the drive shaft and which controls an outflow opening from the pressure chamber as a function of the rotational speed. In its axial extent, this known cam shaft drive arrangement is appreciably larger than a normal cam shaft drive arrangement with constant valve control times. It is therefore practically not possible to provide a particular internal combustion engine either with a normal camshaft drive arrangement or with a camshaft drive arrangement with variable control times or to modify a camshaft with a normal camshaft drive arrangement subsequently to a camshaft with variable control times. If the internal combustion engine is to be installed in motor vehicles and, particularly, in passenger cars, the accommodation of an internal combustion engine, which is only slightly larger in any dimension, creates exceptional problems because of the exceedingly confined space conditions in the engine compartment and these problems frequently necessitate a costly change in the car body.

In the embodiment of the German Offenlegungsschrift 36 16 234, the drive wheel is rotatably supported on bearings at the end of the cam shaft and connected with a sleeve, which protrudes into a recess on the face of the camshaft and has an internal spiral gearing, which interacts with an corresponding external spiral gearing of the gear-change sleeve, which is also disposed in his recess. The gear-change sleeve, moreover, is provided with an external straight gear, which interacts with a corresponding internal straight gear in the aforementioned recess on the face. In this case, the gear-change sleeve is shifted in both directions by oil pressure. For this purpose, the gear-change sleeve is connected over a universal joint with a doubly acting operation piston, which is disposed in a cylinder and divides the space of this cylinder into two working spaces, which either are acted up by oil under pressure or from which such pressure is released. By these means, it becomes possible to shift the gear-change sleeve in both directions and to change correspondingly the position of the camshaft relative to the drive wheel. This drive arrangement for the camshaft has appreciably larger axial dimensions than does a normal camshaft driving arrangement, so that it cannot be installed in place of the latter. Moreover, the camshaft bearing next to the drive wheel must have a much larger diameter than normally, because the camshaft must be constructed with a larger than normal diameter at this end in order to be able to accommodate the adjusting device.

It is an object of the invention to provide a camshaft driving arrangement of the specified type, which is sufficiently compact, so that it can be used without significant changes in the cylinder head instead of the usual camshaft driving arrangement without variable valve control times, so that the possibility exists of offering internal combustion engines of the same type with or without variable valve control.

Pursuant to the invention, this objective is accomplished by means of the features given in the characterizing part of claim 1.

For the inventive proposal, the bearing, which in normal camshaft driving arrangements lies between the last cam and the drive wheel, is made so that it can be used to support the hub of the drive wheel by having the camshaft terminate after the cam adjacent to the drive wheel. This bearing can therefore be used unchanged for the normal camshaft driving arrangement as well as for the camshaft driving arrangement with variable control times. Owing to the fact that the hub of the drive wheel is supported on a bearing on the other side in the cylinder head, an extremely stable support is achieved in comparison with the usual overhang bearing of the known embodiments, the bending stress, caused by the tensile force of the driving means, being significantly reduced. Because the bending moment is less at the driving site, there is less bending there, so that the danger that the gear-change sleeve will get jammed is eliminated and the frictional forces during the axial shifting of the gear-change sleeve are reduced. If a normal camshaft is used instead of the cam shaft driving arrangement with the variable valve control, the one bearing of the drive wheel can, as was stated previously, be used now to support the camshaft. The other bearing of the drive wheel, which is now not required, is closed off by a cover.

If the gear-change sleeve is shifted in the one direction by the force of a spring, as is known from the aforementioned U.S. Patent, then this spring can be disposed between a supporting surface in the recess in the camshaft and the adjacent front surface of the gear-change sleeve. Compared to the arrangement of the aforementioned U.S. patent, in which the spring is supported, on the one hand, at the drive shaft and, on the other, at the gear-change sleeve, this arrangement results in a decrease in the axial extent of the device, since the spring is disposed within the camshaft.

Preferably, the gear-change sleeve is shifted in one direction by oil pressure, while the shift in the other direction can result from the action of a spring or also from the axial component of the force resulting from the spiral gearing. To shift the gear-change sleeve by means of oil pressure, a pressure chamber, in the inflow or outflow section of which a slide valve that can be shifted by an electromagnet that is disposed coaxially in the gear-change sleeve, is provided in accordance with the aforementioned U.S. Pat. No. 3,258,937 or also the German Offenlegungsschrift 33 16 162 between a front surface of the gear-change sleeve and a wall, which is connected with the drive wheel. To save as much space as possible when accommodating the electromagnet, it is proposed that the latter be disposed coaxially to the gear-change sleeve in the cylinder head and protrudes into the hub of the drive wheel, and that the slide valve be connected with the armature of the electromagnet.

The slide valve can be connected with the gear-change sleeve so that there cannot be any rotation. It extends with a rod-shaped extension through the gear-change sleeve and, at its free end, which projects from the gear-change sleeve, it carries a spring plate. Between this spring plate and the front surface of the gear-change sleeve, a spring is disposed, which counteracts the movement of the slide valve that is caused by the electromagnet. Due to the fact that the slide valve and the gear-change sleeve are connected so that there cannot be any rotation, any relative rotation between the spring plate and the gear-change sleeve is prevented, so that an axial bearing to support the spring is not required.

In order to keep the weight of the parts, which are to be moved by the electromagnet, as low as possible and to keep the dimensions of the electromagnet as small as possible, a tubular extension, which protrudes into a blind hole in the front surface of the gear-change sleeve and accommodates the slide valve, can be provided in the wall bounding the pressure chamber. The slide valve can be connected in hinged fashion with the armature of the electromagnet, in order to leave a narrow air gap between the armature and the coil of the electromagnet.

Three examples of the operation of the invention are described in the following with reference to the drawings.

Figure 1:
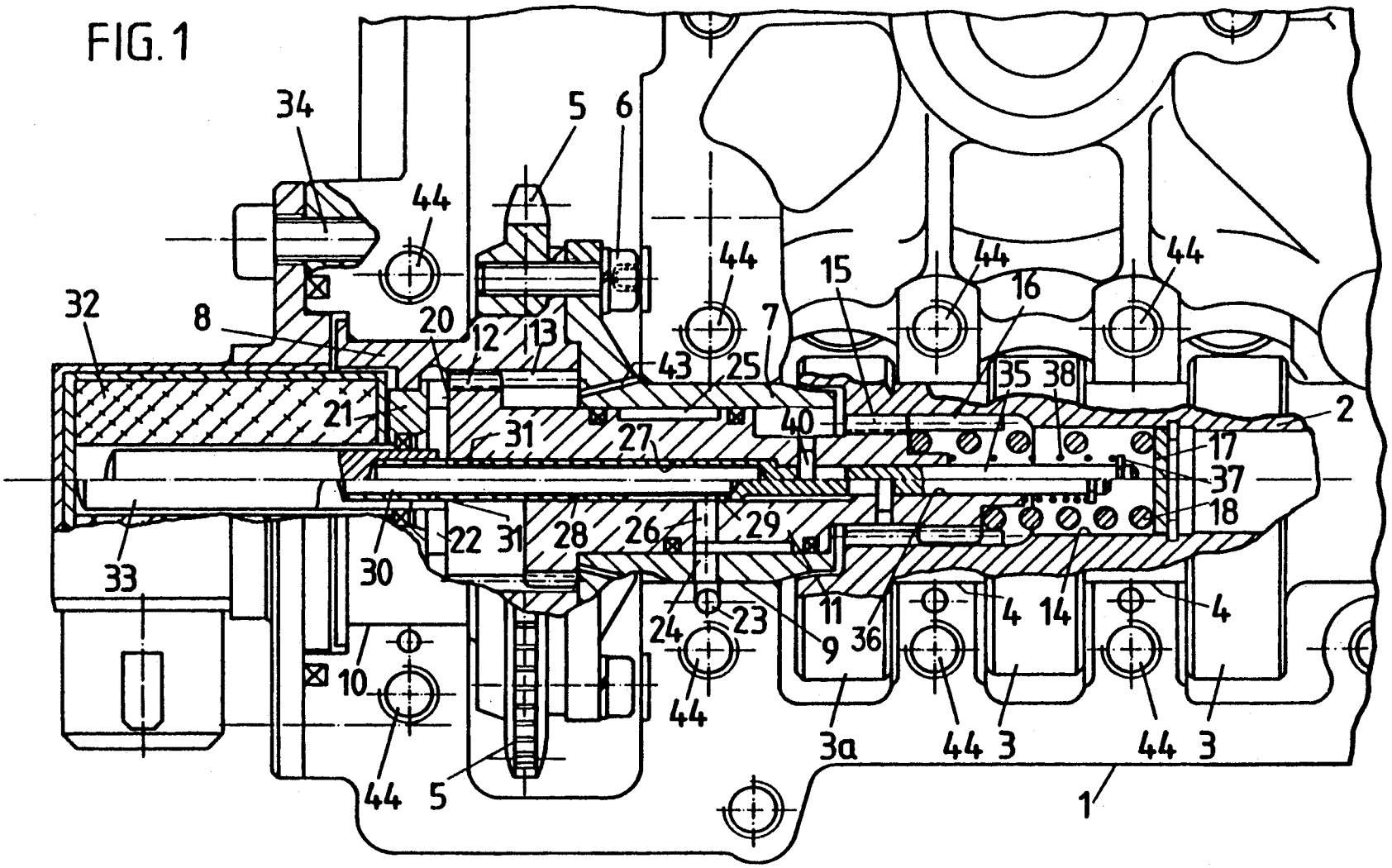
FIG. 1 shows a plan view of a part of a cylinder head of a reciprocating piston internal combustion engine, partially cut away, with a first camshaft adjusting device, the gear-change sleeve being shown in the upper half in the one end position and, in the lower half, in the other end position.

In FIG. 1, the cylinder head of an internal combustion engine, in which a camshaft 2 with a cam 3 is rotatably supported on bearings, is labelled 1. Two bearings 4 are shown in the drawing without the associated bearing covers or bushes.

In the cylinder head 1, a drive gear wheel 5, which is connected by bolts 6 with a 2-part hub 7, 8, furthermore runs coaxially to the cam shaft 2 on bearings. The hub part 7 in cylinder head 1 runs on a bearing 9, which for a camshaft drive without variable valve control serves to support the camshaft between the last cam 3*a* and the drive wheel, which is then on the camshaft. In the present case, as can be seen, the camshaft 2 is cut off behind the last cam 3*a*, so that the bearing 9 is available for supporting the drive wheel 5. On the other side of the drive gear wheel 5, the hub part 8 runs on a further bearing 10 in the cylinder head 1. The threaded holes for the screws, which fasten down the bearing cover that is not shown, are labelled 44.

The gear-change sleeve 11 serves to transfer the rotary force from the drive gear wheel 5 to the camshaft 2. This gear-change sleeve 11 is supported axially displaceably in the hub part 7 and coaxially with the drive gear wheel 5 and with the camshaft 2. It has an external spiral gearing 12, which interacts with a corresponding internal spiral gearing 13 in the second hub part 8. The gear-change sleeve 11 extends into an axial borehole 14 in the camshaft 2 and is provided at its camshaft end with an external straight gear 15, which engages a corresponding straight gear 16 in the wall of the borehole 14. There is provided in the borehole 14 a stop 17, against which a spring 18 is supported, which acts on the gear-change sleeve 11 and endeavors to press this, in the drawing, towards the left.

To attain a change in the angular position of the camshaft 2 relative to the drive gear wheel 5 and, with that, a change in the valve control times, the gear-change sleeve 11 is shifted in the drawing towards the right against the force of the spring 18. Because of the spiral gears 12, 13, the gear-change sleeve 12 is rotated relative to the drive gear wheel 5, and this rotation is transferred by the straight gears 15, 16 to the camshaft 2. In the example of the operation, this shifting of the gear-change sleeve 11 is brought about by the pressure of the lubricating oil, which serves to lubricate the bearing of the camshaft and of the drive gear wheel 5. For this purpose, a pressure chamber 22, to which oil under pressure is supplied from a compressed oil borehole 23 in the cylinder head 1, is provided between the left front side 20 of the gear-change sleeve 11 and a front wall 21 that is connected with the hub part 8. The oil under pressure flows through a radial duct 24 in the hub part 7 into a broad circumferential groove 25 in the circumferential surface of the gear-change sleeve 11 and from there into a transverse duct 26, which ends in a longitudinal borehole 27 in the gear-change sleeve 11, in which a tubular slide valve 28 is disposed. The oil under pressure can pass from the transverse duct 26 through a longitudinal slot 29 in the wall of the slide valve 28 into the interior space 30 of the latter and flow from there through the openings 31 in the wall of the slide valve 28 into the pressure chamber 22, when the slide valve 28 is shifted by an appropriate amount in the drawing towards the left, as is shown in the lower half of FIG. 1. This shifting of the slide valve 28 is brought about with the help of an electromagnet 32, the armature 33 of which is connected with the slide valve 28. The electromagnet 32 is bolted with bolts 34 to the cylinder head 1 and extends into the hub part 8, by which means the overall length of the camshaft drive arrangement is kept as small as possible.

The slide valve 28 extends with a rod-shaped extension 35 through an axial passage borehole 36 into the gear-change sleeve 11 and is provided at its free end, which protrudes from the gear-change sleeve 11, with a spring plate 37. A weak spring 38, the only task of which is to return the slide valve 28, when the electromagnet 32 is switched off, into its initial position, which is shown in the upper half of FIG. 1, is disposed between the spring plate 37 and the adjacent front end of the gear-change sleeve 11. The rod-shaped extension 35 is furthermore connected by means of a radial pin 40, which engages a longitudinal slot, with the gear-change sleeve 11 so that it cannot rotate but can be shifted axially. Consequently, there can be no relative rotary motion between it and the gear-change sleeve 11 and it is unnecessary to construct the spring plate 37 as an axial bearing.

The mode of action of the device shown for changing the phase position between the camshaft 2 and the drive gear wheel 5 is as follows.

It is assumed that the electromagnet 32 is not energized in normal operation and that the gear-change sleeve 11 is pressed by spring 18 into the left end position shown in the upper half of FIG. 1. If, in a certain operating range, a change is desired in the control times of the valves actuated by the cams 3, the electromagnet 32 is energized and by these means the armature 33, together with the slide valve 28, is pushed to the left against the action of the spring 38, as is shown in the lower half of FIG. 1. By these means, the openings 31 in the wall of the slide valve 27 are connected with the pressure chamber 22 and the oil under pressure can flow from the oil borehole 23, through the borehole 24, the circumferential groove 25, the transverse borehole 26 the longitudinal slot 29, the interior space 30 of the slide valve 28 and the openings 31 into the pressure chamber 22. By means of the pressure building up in this chamber 22, the gear-change sleeve 11 is shifted against the action of the spring 18 to the right in the drawing and the gear-change sleeve 11 is rotated because of the spiral gearing 12, 13 and the camshaft 2 is rotated correspondingly by means of the straight gearing 15, 16. If the electromagnet 32 is de-energized, the slide valve 28 is returned by the spring 28 into the position, which is shown in the upper half of FIG. 1 and in which the supply of oil under pressure to the pressure chamber 22 is interrupted. This pressure chamber 22 is connected over intertooth spaces of the spiral gearing 12, 13 and a choke borehole 43 with the pressureless space in the cylinder head 1, so that the oil under pressure can escape from the pressure chamber 22 and the spring 18 can shift the gear-change sleeve 11 to the left, as a result of which the original left position of the cam shaft relative to the drive gear wheel 5 is restored. The choke borehole 43 is dimensioned so that it does not diminish the build-up of pressure in the pressure chamber 22 in the position of the control slide 28 shown in the lower half of FIG. 1, since in this position the pressure chamber 22 is constantly supplied with oil under pressure.

If the cylinder head 1 is to be provided with a normal camshaft without a device for changing the valve control times, the bearing 9 or 10 is used to support the camshaft between the last cam and the drive wheel, which is mounted on the end of the camshaft so that there cannot be any rotation, and the opening of the bearing 10 is closed off by a cover. For this, no changes are required to be made in the cylinder head 1.

Figure 2:
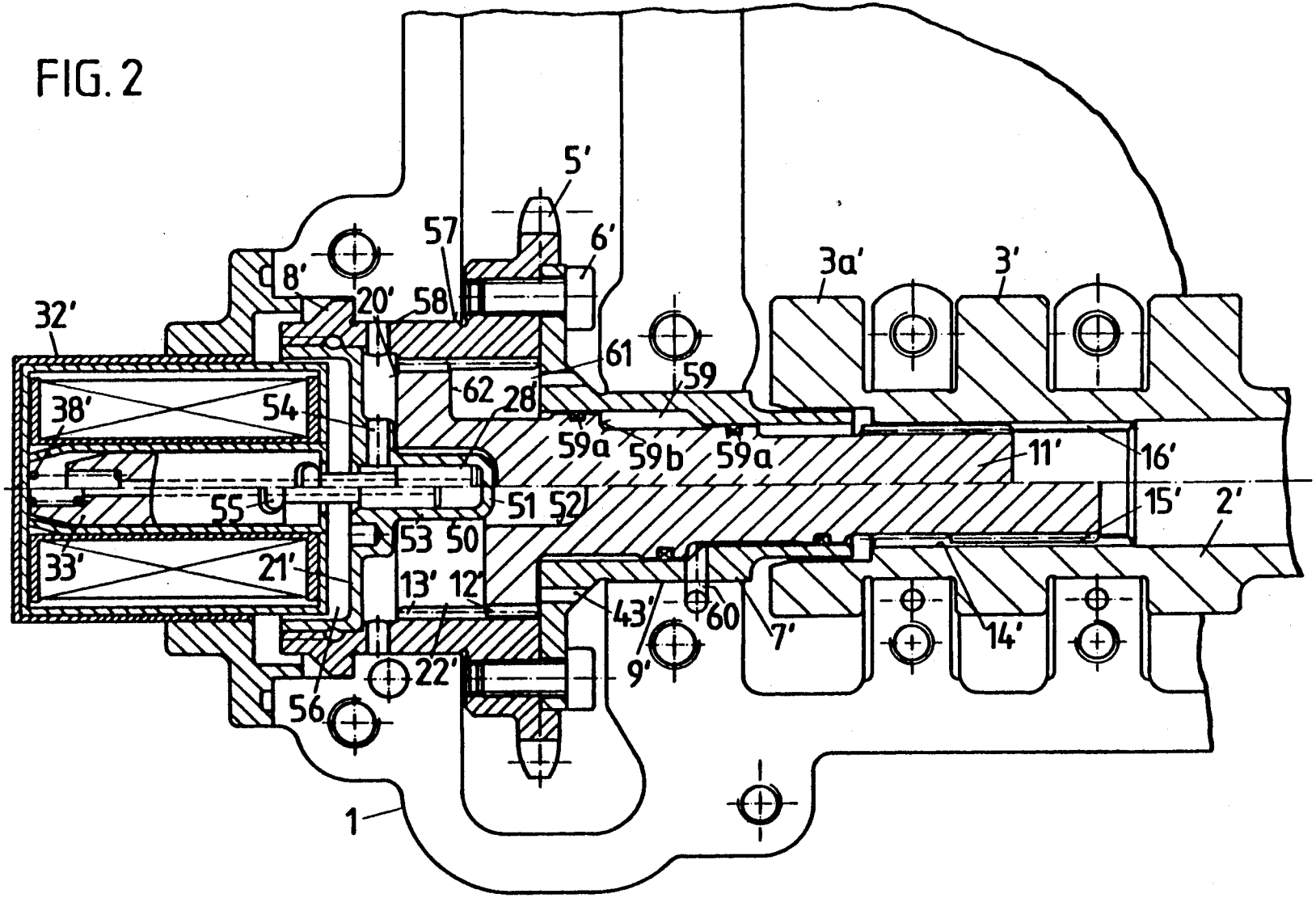
FIG. 2 shows a section, similar to that of FIG. 1, of a second example of the operation, the gear-change sleeve once again being shown in the upper half in the one end position and, in the lower half, in the other end position.

The example of the operation of FIG. 2, for which the same or similar parts are provided with the same reference symbols as in FIG. 1 but with a prime, differs from the example of the operation of FIG. 1 primarily by a system for controlling the pressure in pressure chamber 22' that is significantly simpler. The front wall 21', which bounds the pressure chamber 22', is provided with a centric, tubular continuation 50, which is closed at its end 51 and in the (shown in the upper half of FIG. 2) left end position of the gear-change sleeve 11' protrudes with radial clearance into a central blind hole 52 in the front wall 20' of the gear-change sleeve 11'. In the tubular extension 50, the wall 53 of which is provided with a passage opening 54, there is disposed the slide valve 28', which is connected flexibly (with angular mobility) with the armature 33' of the electromagnet 32' by means of a radial flange 55. The armature 33' and, with it, the slide valve 28' are pushed by a weak spring 38' into the right position of rest, which is shown in the upper half of FIG. 1 and in which the opening 54 is unblocked by the slide valve 28' and the pressure chamber 22' is connected with an oil recycling space 56 outside of the pressure chamber 22'. The oil under pressure is supplied to the pressure chamber 22' over the bearing surface 57 of the hub part 8' and radial ducts 58 in the hub part 8'. In the position shown in the upper half of FIG. 2, the opening 54, as mentioned, is unblocked and the pressure in the pressure chamber 22' is thus released. The movement of the gear-change sleeve 11' into its left end position is accomplished here by the axial force, which is exerted by the spiral gearing 12', 13' and acts towards the left, as well as by the oil pressure in an annular chamber 59 between the circumferential surface of the gear-change sleeve 11' and the interior surface of the hub part 7', which surface is bounded by sealing rings **59*a* to which lubricating oil is supplied under pressure through a duct 60. The oil pressure acts on the left front surface 59*b* of this annular chamber 59 and accordingly endeavors to push the gear-change sleeve 11' to the left. If the electromagnet 32' is energized and, by these means, the armature 33' is pushed with the slide valve 28' to the left, as shown in the lower half of FIG. 2, the opening 54 is blocked by the slide valve 28' and pressure, which acts on the left front surface 20' of the gear-change sleeve 11' and pushes said sleeve towards the right against the axial force of the spiral gearing 12, 13 and the pressure in the annular chamber 59, can now build up in the pressure chamber 22. The chamber 61 between the right front surface 62 and the hub part 7' is vented, as in the first example of the operation, through the boreholes 43'**.

In the embodiment of FIG. 1, because the slide valve 28 is mounted in the gear-change sleeve 11, which is rigidly connected with the armature 33 and in view of the manufacturing tolerances, a relatively large air gap must be provided between the armature 33 and the coil of the electromagnet 32. As a result, a larger magnetic force and an electromagnet of correspondingly large dimensions are required, particularly since the mass (slide valve 28, rod 35), which is to be moved by the electromagnet, is relatively large. In the example of the operation of FIG. 2 on the other hand, the mass of the slide valve 28' is considerably less and fewer tolerances need be taken into consideration, as a result of which said air gap can be small and the electromagnet 32' can have smaller dimensions. In view of the extremely confined space relationships, this is of great importance, particularly for accomplishing the task of providing an existing internal combustion engine with such a variable valve control. A further advantage of the embodiment of FIG. 2 consists therein that the whole of the front surface 20' of the gear-change sleeve 11', including the front surface of the blind hole 52, is exposed to the oil pressure, so that larger adjusting forces can be exerted on the gear-change sleeve 11'.

Figure 3:
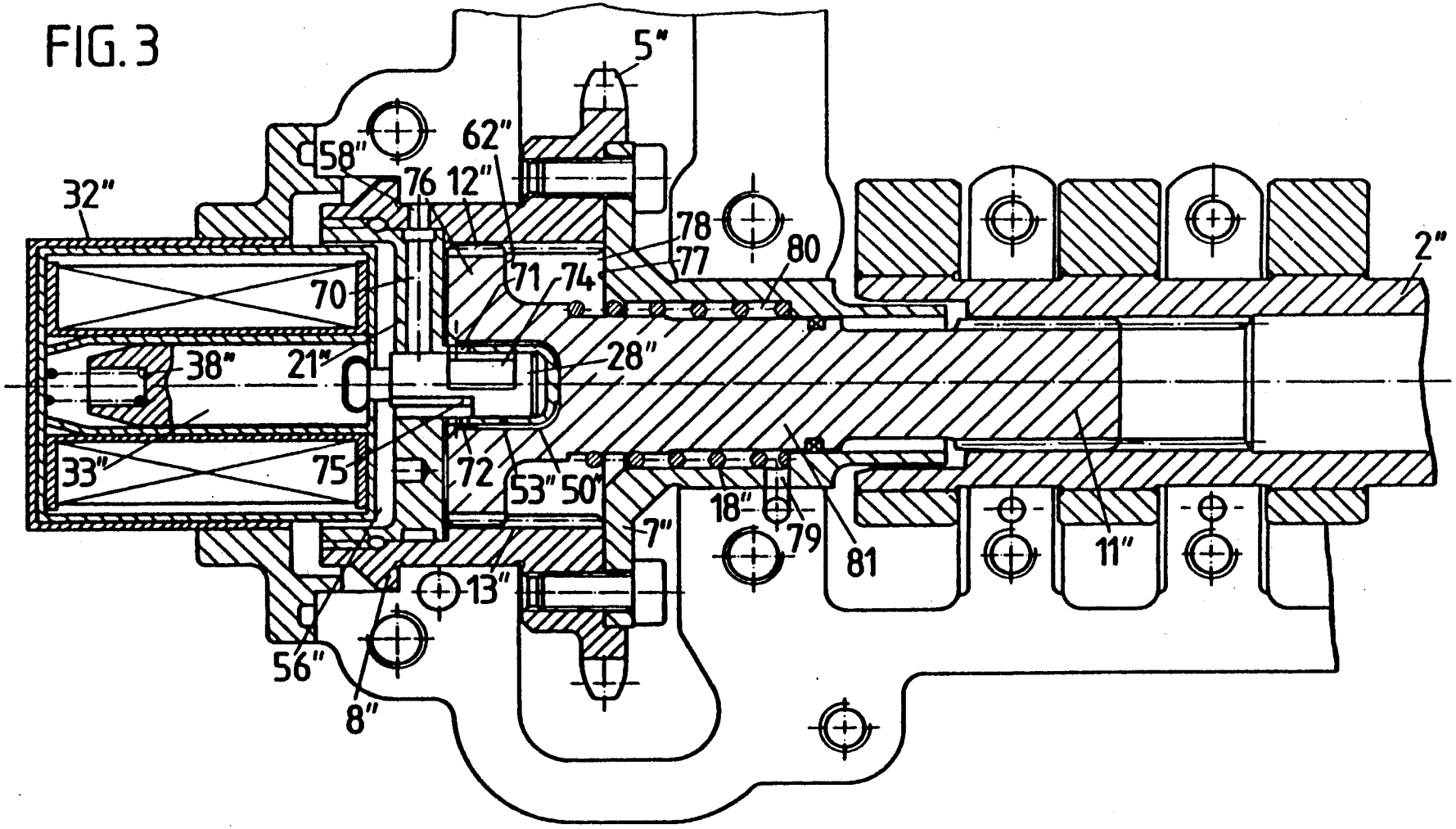
FIG. 3 shows a modification of the embodiment of FIG. 2, the gear-change sleeve being shown in the one end position.
Figure 4:
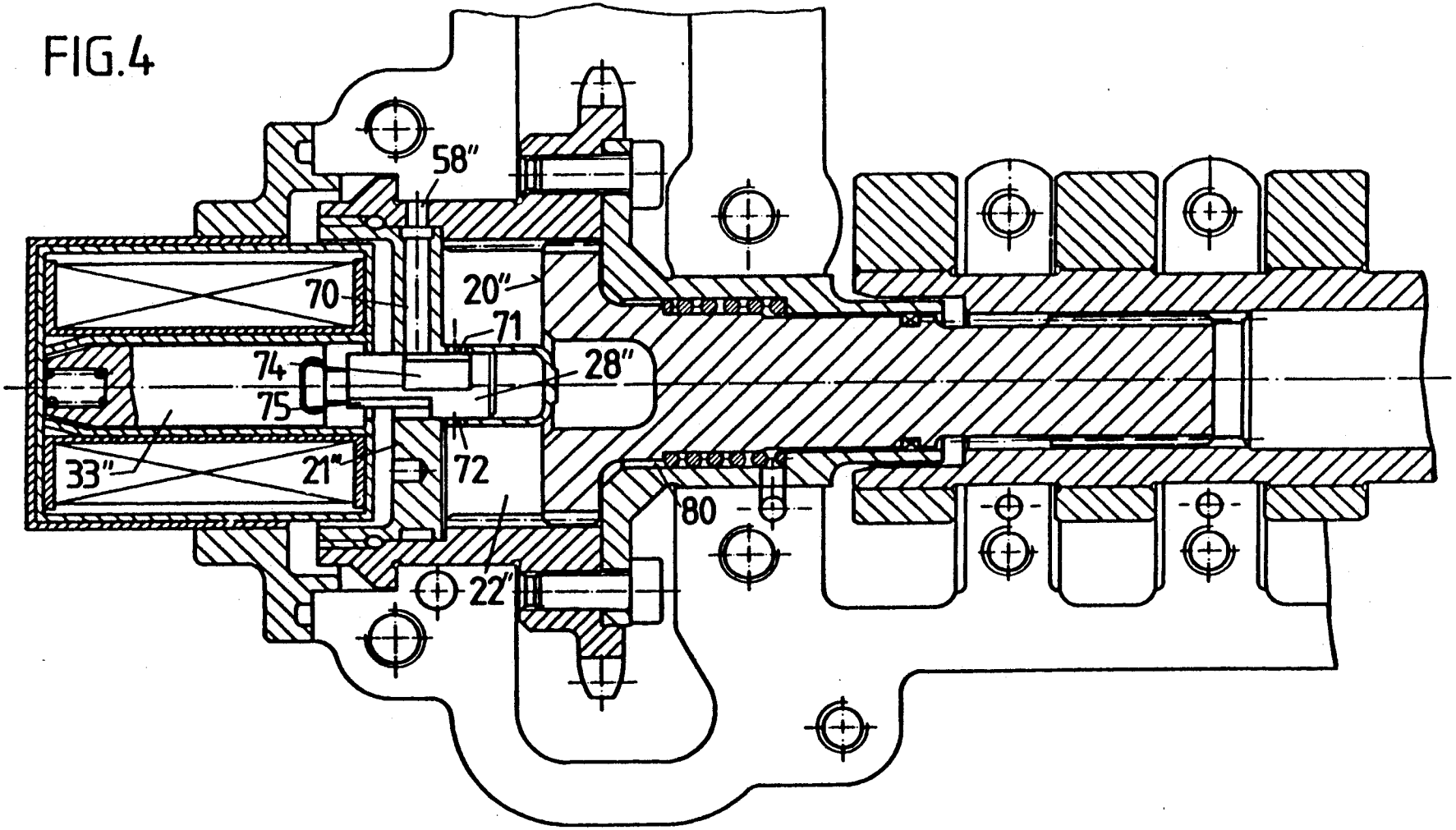
FIG. 4 shows the embodiment of FIG. 3 with the gear-change sleeve in the other end position.

In the example of the operation of FIGS. 3 and 4, in which the same or similar parts are provided with the reference symbols, which are the same as those in FIG. 2 but have a double prime, the oil under pressure flows to the pressure chamber 22'' (FIG. 4) through a duct 70 in the wall 21'', the duct 70 being connected with the radial duct 58'' in the hub part 8''. The wall 53'' of the extension 50'' has an inflow opening 71 and an outflow opening 72, which are connected with the pressure chamber 22". The slide valve 28" is provided with two overflow ducts 74 and 75, which are offset axially and in the circumferential direction. Of these, the overflow duct 74 connects the inflow duct 70 with the inflow opening 71, when the slide valve 28" is in its left end position (FIG. 4) and the overflow duct 75 connects the outflow opening 72 with the oil recycling space 56", when the slide valve 28" is in its right end position (FIG. 3).

In this embodiment, the annular front surface 62" of the gear-change sleeve section 76, which bears the spiral gearing 12", bounds with wall 77 of the hub part 7" a chamber 78, which is supplied with lubricating oil under pressure over a duct 79 and the annular gap 80 between the circumferential surface of the thinner section 81 of the gear-change sleeve 11" and the hub part 7". The pressure in the chamber 78 endeavors to move the gear-change sleeve 11" in FIG. 3 towards the left. This endeavor is supported by spring 18".

The mode of action of this embodiment is as follows. In FIG. 4, the slide valve 28" is in its left end position, in which there is a connection between the inflow duct 70 for the oil under pressure and the pressure chamber 22". Since the front surface 20" of the gear-change sleeve 11" is larger than the annular surface 62", the gear-change sleeve 11" is moved against the pressure in chamber 78 and against the action of the spring 18" towards the right into the position of FIG. 4. At the same time, because of the spiral gearing 12", 13", there is a corresponding rotation of the camshaft 2" relative to the drive gear wheel 5", as was described in connection with FIG. 1. If after the energizing of the electromagnet 32" the slide valve 28" is pushed by the spring 38" towards the right, as is shown in FIG. 3, the overflow duct 75 connects the pressure chamber 22" over the outflow opening 72 with the oil recycling space 56", while the inflow channel 70 is blocked. Together with spring 18", the oil pressure, acting in the chamber 78, can move the gear-change sleeve towards the left, by which means the rotation of the camshaft 2" is cancelled once again. Compared to the embodiment of FIG. 1, this embodiment has the additional advantage that the gear-change sleeve 76 is acted on both sides with the same oil pressure, so that there is no leakage over the gearing 12", 13" and a seal between the gear-change sleeve 11 or 11' and the hub part 7 or 7' can be omitted, as is shown by a comparison of FIGS. 1 and 2 with FIG. 3. By these means, space is saved once again in the axial direction.

The spiral gearing 12", 13" can, in this case, be disposed so that its axial thrust acts towards on the right on the gear-change sleeve 11", since the pressure of the lubricating oil, which acts upon the annular front surface 62", is utilized for a movement towards the left.

I claim:

1. A drive arrangement for a camshaft (2) of an internal combustion engine, with a device for rotating the camshaft (2), which runs on bearings in the cylinder head (1) of the internal combustion engine, relative to a coaxial drive wheel (5), with a shift sleeve (11), which is disposed coaxially to the camshaft (2), can be shifted axially between two end positions and is connected on one end to the drive wheel (5) by a spiral gear (12, 13) and on an other end to the camshaft (2) by a straight gear (15, 16) that is disposed axially next to the shift sleeve (11) and protrudes with the other end into a recess (14) in the end of the camshaft (2) adjacent to the drive wheel (5), characterized in that the drive wheel (5) is disposed on a hub (7, 8), which runs on bearings in the cylinder head (1) on either side of the drive wheel (5) and that the camshaft (2) ends between a cam (3*a*) adjacent to the drive wheel (5) and the cylinder head bearing adjacent to this cam.

2. The drive arrangement of claim 1, characterized in that the hub (7, 8) of the drive wheel (5) has an internal spiral gearing (13), which is symmetrical to the drive wheel (5) and engages a corresponding external spiral gearing (12) on the outer surface of the shift sleeve (11).

3. The drive arrangement of claim 1, in which the shift sleeve is shifted in one direction by the force of a spring, characterized in that the spring (18) is disposed between a supporting surface (17) in the recess (14) in the camshaft (2) and the adjacent front surface of the shift sleeve (11).

4. The drive arrangement of claim 1, in which the shift sleeve (11) is shifted in one direction by oil pressure, characterized by a) a pressure chamber (22) between a front surface (20) of the shift sleeve (11) and a cover (21), which closes off the hollow hub (7, 8) of the drive wheel (5) on one side, b) a slide valve (28), which is disposed coaxially to the shift sleeve (11) for controlling the flow into and/or out of the pressure chamber, and c) an electromagnet (32), which is disposed coaxially to the shift sleeve (11) in the cylinder head (1), protrudes into the hub of the drive wheel and the armature (33) of which is connected directly with the slide valve (28).

5. The drive arrangement of claim 4, characterized in that the slide valve (28) is connected with the shift sleeve (11) so that there can be no rotation and extends with a rod-shaped extension (35) through the shift sleeve (11), that the free end of the extension (35), which protrudes beyond the shift sleeve (11), carries a spring plate (37) and that a spring (38) is disposed between this spring plate (37) and the front surface of the shift sleeve (11), and counteracts the motion of the slide valve (28) caused by the electromagnet (32).

6. The drive arrangement of claim 4, characterized in that the wall (21', 21") has a centric, tubular extension (50, 50"), the end of which is closed, that the front surface (20', 20") of the shift sleeve (11', 11") has a centric, blind hole (52) for the at least intermittent accommodation of the extension (50, 50"), that the slide valve (28', 28") is disposed in the extension and that oil inflow and/or outflow openings (54 and 71,72 respectively), which are controlled by the slide valve (28', 28") and connected with the pressure chamber (22', 22"), are provided in the wall (53, 53") of the extension (50).

7. The drive arrangement of claim 6, characterized in that at least one oil inflow duct (58), which is constantly connected with the chamber (22'), is provided in the hub (7', 8') of the drive wheel and at least one oil outflow opening (54), which is connected at one end with the pressure chamber (22') and at an other end with an oil recycling space (56), is provided in the wall (53) of the extension (50).

8. The drive arrangement of claim 6, characterized in that an oil inflow duct (70) is provided in the wall (21"), that an inflow opening (71) and an outflow opening (71) are provided in the wall (53") of the extension (50"), and that the slide valve (28") has two overflow ducts (74, 75), which are offset axially and in the circumferential direction to one another, the one overflow duct (74) of which, depending on the position of the slide valve, is connected with the inflow duct (70) and the inflow opening (71) or the other overflow duct (75) of which is connected with the outflow opening (72) and with an oil recycling space (56'') outside of the pressure chamber (22'').

9. The drive arrangement of claim 4, characterized in that the slide valve (28', 28'') is hinged to the armature (33', 33'') of the electromagnet (32', 32'').

10. The drive arrangement of claim 4, characterized in that the section (76) of the shift sleeve (11''), which carries the external gearing (12'') that has engaged the internal gearing (13'') of the drive wheel hub, directly adjoins the front surface (20'') of the shift sleeve (11) and has a larger diameter than the thereon adjoining section (81), which is guided in the hub, and that the thereby formed annular front surface (62'') of the shift sleeve section (76), which is provided with an external gearing, together with a structural part (7''), forms the boundary of a chamber (78), which is connected with the same source of oil as the pressure chamber (22'').

* * * * *